US009413119B2

(12) United States Patent
Zhong et al.

(10) Patent No.: US 9,413,119 B2
(45) Date of Patent: Aug. 9, 2016

(54) ELECTRICAL CONNECTOR WITH AN IMPROVED MATING PLATE

(71) Applicant: FOXCONN INTERCONNECT TECHNOLOGY LIMITED, Grand Cayman (KY)

(72) Inventors: Wei Zhong, Kunshan (CN); Chun-Sheng Li, Kunshan (CN); Jian-Kuang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/855,315

(22) Filed: Sep. 15, 2015

(65) Prior Publication Data

US 2016/0006196 A1 Jan. 7, 2016

Related U.S. Application Data

(63) Continuation-in-part of application No. 14/531,978, filed on Nov. 3, 2014, now Pat. No. 9,257,801.

(30) Foreign Application Priority Data

Nov. 1, 2013 (CN) ..... 2013 2 0682317 U
Sep. 15, 2014 (CN) ..... 2014 1 0467282

(51) Int. Cl.

| | |
|---|---|
| ***H01R 13/648*** | (2006.01) |
| ***H01R 24/60*** | (2011.01) |
| ***H01R 43/24*** | (2006.01) |
| ***H01R 13/6587*** | (2011.01) |
| ***H01R 43/20*** | (2006.01) |
| *H01R 107/00* | (2006.01) |

(52) U.S. Cl.

CPC ..... *H01R 24/60* (2013.01); *H01R 13/6587* (2013.01); *H01R 43/20* (2013.01); *H01R 43/24* (2013.01); *H01R 2107/00* (2013.01); *Y10T 29/4922* (2015.01); *Y10T 29/49208* (2015.01); *Y10T 29/49211* (2015.01)

(58) Field of Classification Search

CPC .... H01R 2107/00; H01R 43/24; H01R 24/60; H01R 13/6587; H01R 43/20; H01R 12/57; H01R 13/514; H01R 12/71; Y10T 29/49208; Y10T 29/4922; Y10T 29/49211

USPC ..... 439/607.23

See application file for complete search history.

(56) References Cited

U.S. PATENT DOCUMENTS

| | | | | |
|---|---|---|---|---|
| 8,936,493 | B2 * | 1/2015 | Fan | H01R 13/514 439/660 |
| 9,281,583 | B2 * | 3/2016 | Yuan | H01R 12/71 |
| 2009/0170372 | A1 * | 7/2009 | Wang | H01R 12/57 439/607.23 |

FOREIGN PATENT DOCUMENTS

| | | |
|---|---|---|
| TW | M394623 | 12/2010 |

*Primary Examiner* — Jean F Duverne

(74) *Attorney, Agent, or Firm* — Wei Te Chung; Ming Chieh Chang

(57) ABSTRACT

An electrical connector comprises a base plate and a pair of terminal modules, the base plate defines a tongue plate. Each terminal module includes a plurality of terminals and an insulative housing inserted molding with the terminals. A pair of concave portions forms on opposite sides of the tongue plate, the two terminal modules are received in said concave portions respectively. An insulative shell is injection molded over outer sides of the terminal modules and commonly forms a mating plate, the terminals define a contacting portion exposed to two opposite surfaces of the mating plate. Said electrical connector can increase the binding force of the terminal modules and the base plate.

10 Claims, 8 Drawing Sheets

ELECTRICAL CONNECTOR WITH AN IMPROVED MATING PLATE

BACKGROUND OF THE INVENTION

1. Field of the Invention

The present invention relates generally to an electrical connector, and more specifically, to a method for producing an electrical connector with an improved mating plate. This application relates to the copending application Ser. No. 14/531,978 filed Nov. 3, 2014 and another application with an unassigned serial number filed on Sep. 15, 2015 with a title of "ELECTRIC CONNECTOR ASSEMBLY WITH A RELIABLE LOCKING DEVICE", both having the same applicant and the same assignee with the instant invention.

2. Description of Related Arts

An electrical connector is disclosed in TW Pat. No. M394,623 issued to Zhang et al. on Dec. 11, 2010. Said electrical connector includes a base body, a terminal module assembles to the base body and a metal shell covering around the base body and the terminal modules. A pair of first locking portions are protrude from opposite sides of the terminal module, the base body defines a pair of second locking portions lock with the pairs of the first locking portions. Thus, said terminal module can be retained to the base body. However, assembling the electrical connector by this way generally causes the terminal module fall off the base body.

Hence, an electrical connector having a good bind force is desired.

SUMMARY OF THE INVENTION

Accordingly, an object of the present invention is to provide an electrical connector with an improved mating plate.

To achieve the above object, a electrical connector comprises a base plate and a pair of terminal modules, the base plate defines a tongue plate, each terminal module defines a plurality of terminals and an insulative housing inserted molding with the terminals. A pair of concave portions are formed on opposite sides of the tongue plate, said two terminal modules are received in the two concave portions respectively, an insulative shell is injection molded over outer sides of the terminal modules and commonly forms a mating plate together with the tongue plate, the terminals define contacting portions exposed to two opposite surfaces of the mating plate.

Other objects, advantages and novel features of the invention will become more apparent from the following detailed description when taken in conjunction with the accompanying drawings.

DETAILED DESCRIPTION OF THE PREFERRED EMBODIMENT

Figure 1:
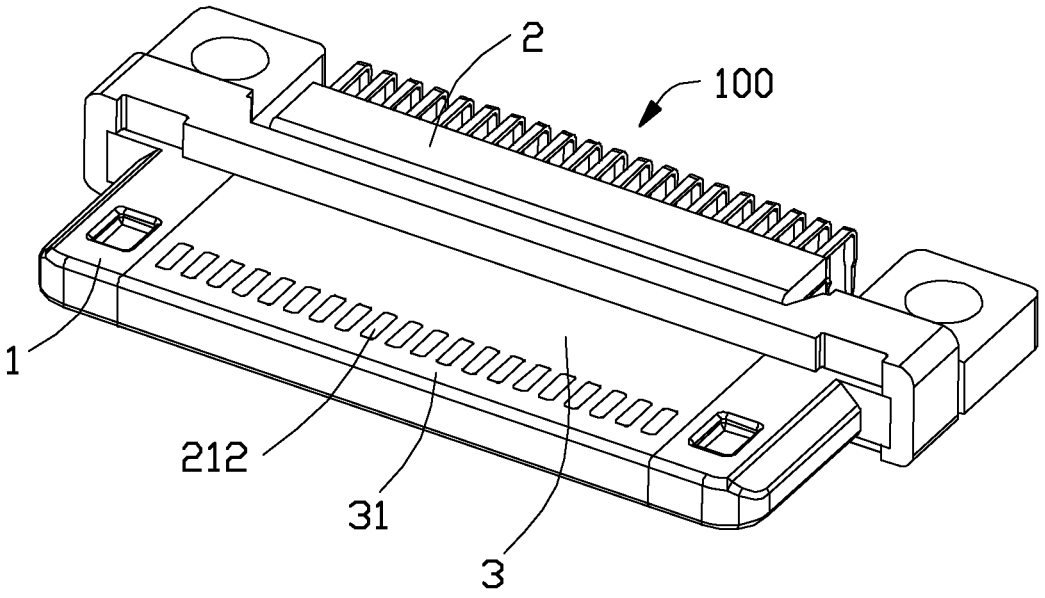
FIG. 1 is a perspective view of an electrical connector in accordance with the present invention.

Reference will now be made to the drawing figures to describe the preferred embodiment of the present invention in detail.

Figure 2:
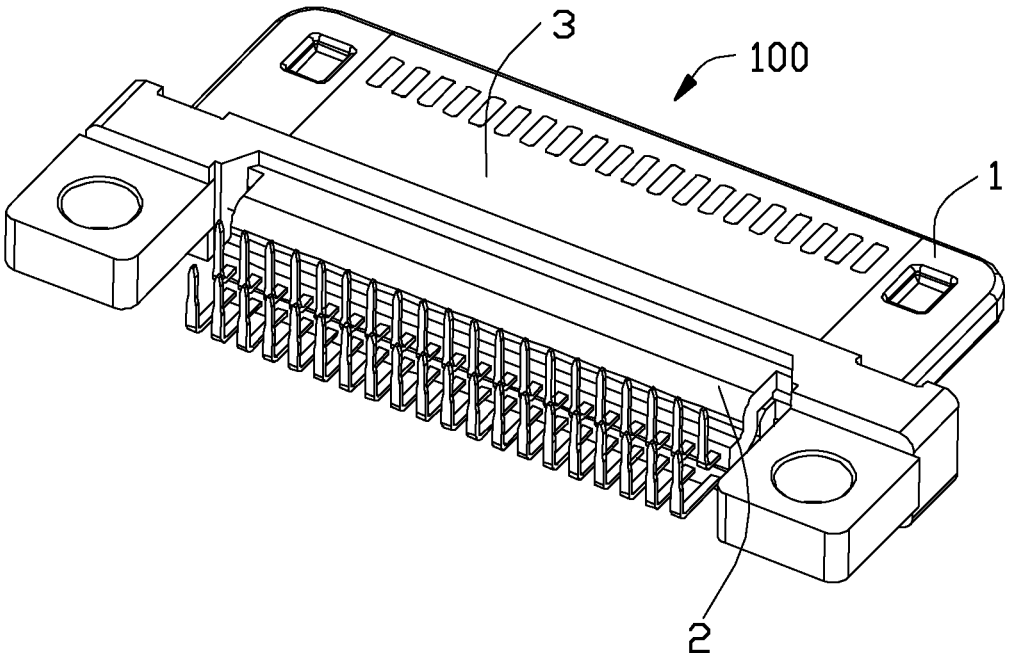
FIG. 2 is a perspective view of the electrical connector from another view.

Referring to FIGS. 1-2, a electrical connector 100 according to the present invention is used for mating with a mating connector (no shown), said electrical connector can be put or mounted as any type. In the present invention, said electrical is mounted by a horizontal type.

Figure 3:
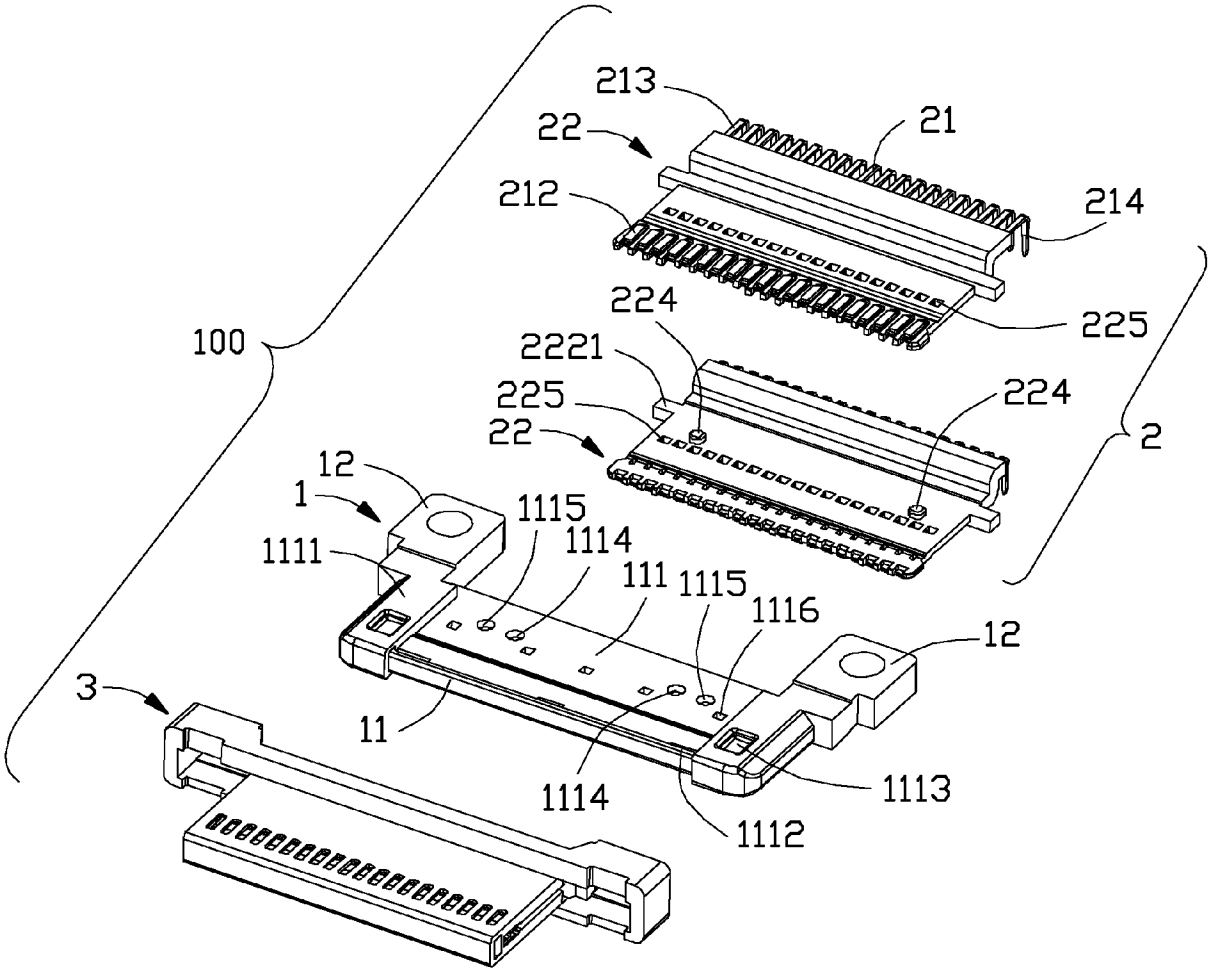
FIG. 3 is an exploded perspective view of the electrical connector shown in FIG. 1.
Figure 4:
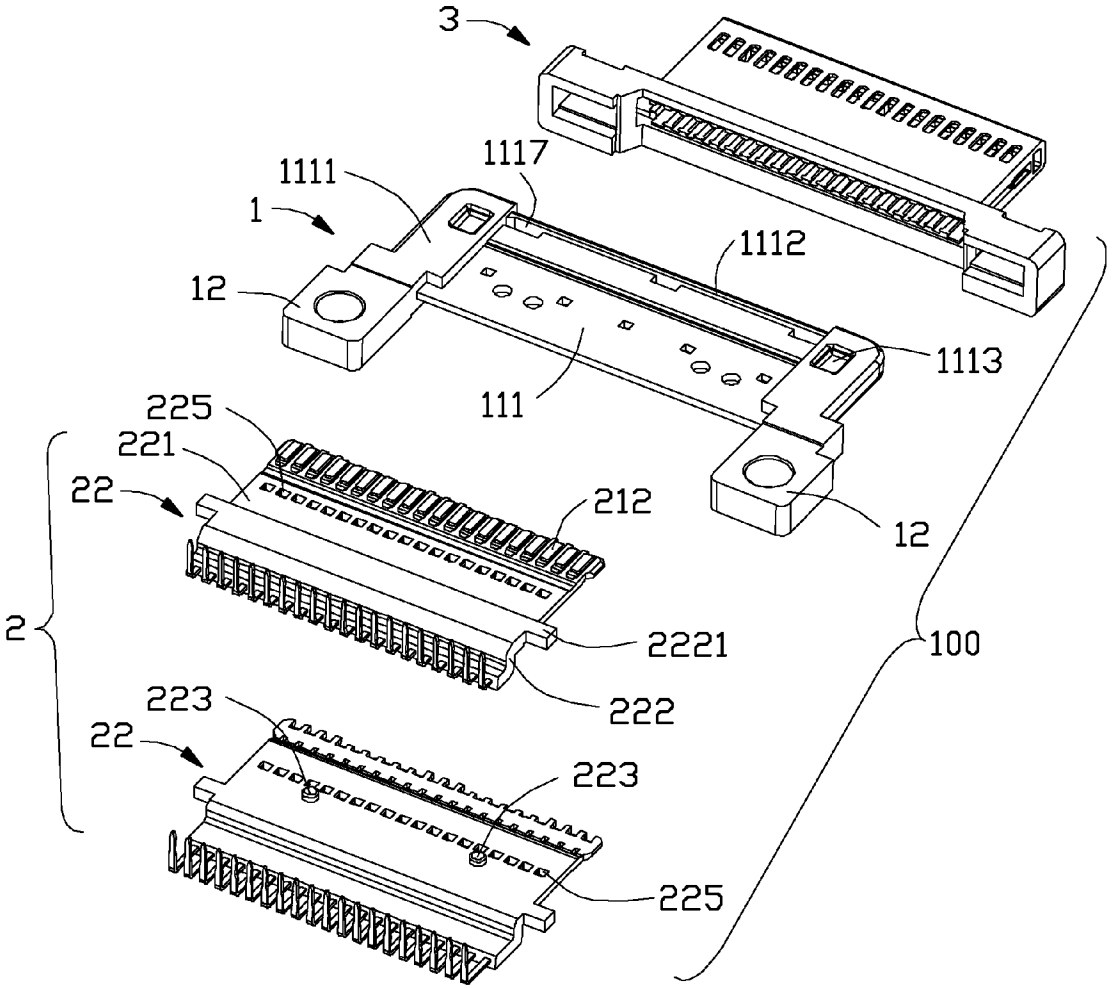
FIG. 4 is an exploded perspective view of the electrical connector shown in FIG. 2.

Referring to FIGS. 3-4, the electrical connector defines a base plate or base 1, a pair of terminal modules 2 and an insulative shell or cover 3, said two terminal modules 2 are retained on opposite sides of the base plate 1, an insulative shell 3 is injection molded over outer sides of the terminal modules 2 and the base plate 1. The base plate 1 is a metal plate and which is made via powder metallurgy. The base plate 1 defines an elongated tongue plate 11, a pair of mounting portions 12 locate on opposite sides of a rear side of the tongue plate 11, each terminal module 2 comprises a plurality of terminals 21 and an insulative housing 22 inserted molding on the terminals 21. The base plate 1 defines a pair of concave portions 111 on opposite sides of the tongue plate 11, said two terminal modules 2 are retained in the two concave portions 111 in a upper direction and a under direction respectively.

The insulative housing 22 of the terminal module 2 defines a front plate 221 located at a front side and a rear plate 222 located at a rear side, a pair of protruding portions 2221 are located on opposite sides of the rear plate 222 in a lateral direction. Said protruding portions 2221 abuts on the rear side of the tongue plate 11, said front plate 222 is retained in the concave portion 111, said rear plate 222 are retained between the two mounting portions 12. Each concave portion 111 defines a pair of first wall portions 1111 and a second wall portion 1112, said two first wall portions 1112 are located on opposite sides of the concave portion 111 in the lateral direction and the second wall portion 1112 which extends between said two first wall portions 1111 is located at a front side of the concave portion 111, said pairs of first wall portion 1111 is used for limiting the terminal module 2 moves in the lateral direction, said second wall portion 1112 cooperatively with the protruding portion 2221 limiting the terminal module 2 move forward. On opposite sides of each first wall portions 1111 define a pair of retaining slots or recesses 1113 respectively, said retaining slot 1113 is used for locking with the mating connector (no shown) and electrical connector 100.

The terminal 21 includes a body portion (no shown) which covered with the front plate 221, a contacting portion 212 located at a front side of the body portion (no shown) which defines a great thickness than the body portion (no shown), a bending portion 213 locates at a rear side of the body portion (no shown) which extends upwardly and backwardly from the body portion (no shown), and soldering portion 214 extends downwardly from the free end of the bending portion 213. A part of said bending portion 213 is covered with the insulative housing 22, the terminal 21 manufacturing by punch-shaping method except the contacting portion 212. The bending portion 213 and soldering portion 214 are commonly form a U-shape, the electrical connector 100 in the present invention has a low height when said electrical connector 100 is mounted on a PCB.

Figure 5:
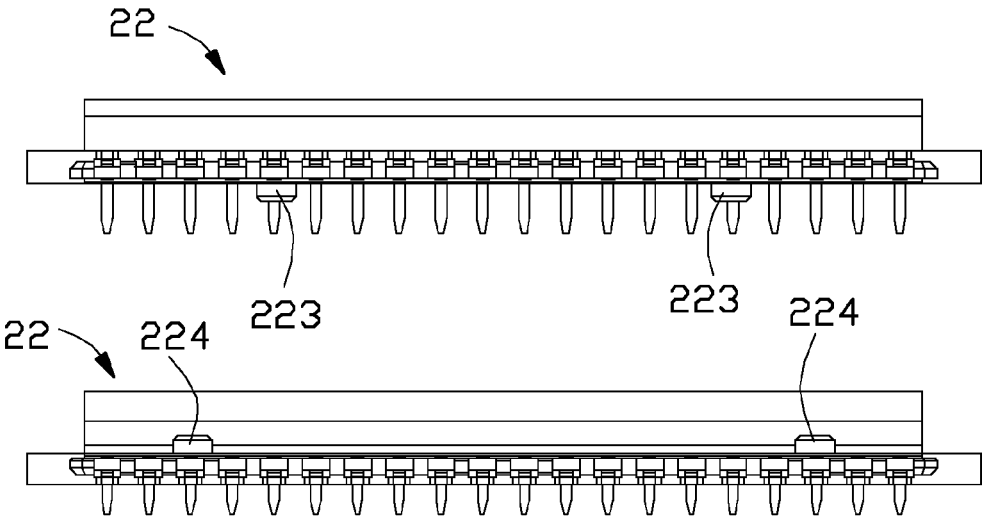
FIG. 5 is a perspective view of a terminal module of the electrical connector.

Combining to FIG. 5, one of the terminal module 2 has a pair of first retaining posts 223 locates on opposite sides of a bottom surface of the insulative housing 22, another terminal module 2 has a pair of second retaining posts 224 locates on opposite sides of the bottom surface of the insulative housing 22, the two second retaining posts 224 are located at an outer side of the two first retaining posts 223. The concave portion 111 defines a pair of first retaining holes 1114 and second retaining holes 1115 run through the tongue plate 11 for receiving the first retaining post 223 and second retaining posts 223 respectively.

Figure 6:
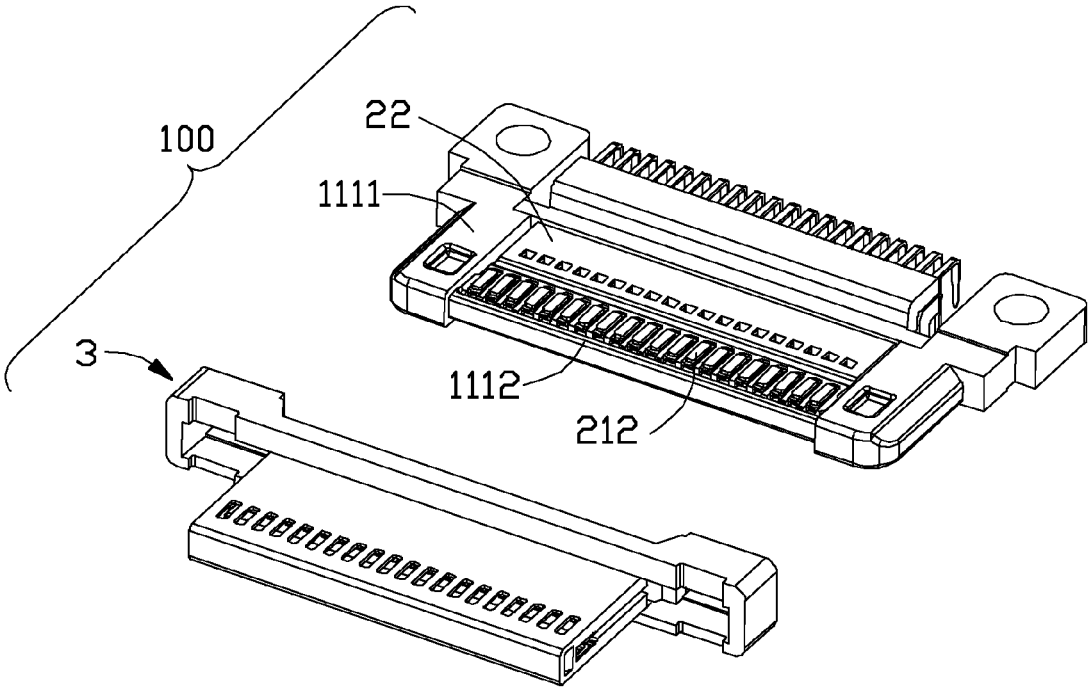
FIG. 6 is a separated view of an insulative shell, a base plate and the terminal module of the electrical connector.
Figure 7:
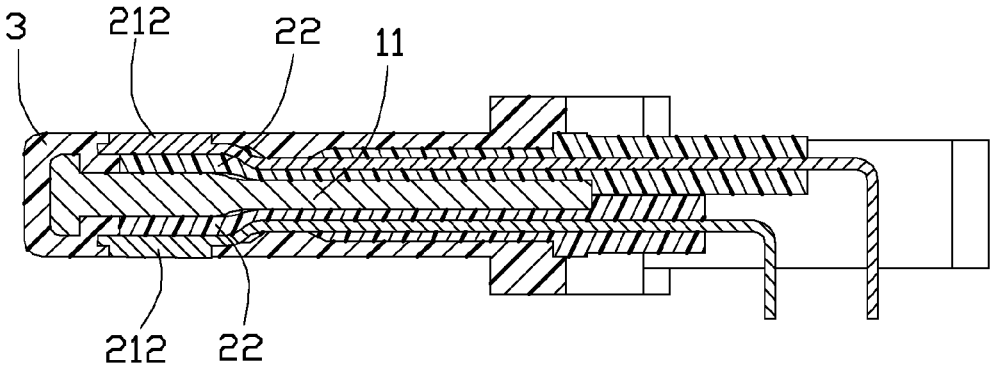
FIG. 7 is a cross-sectional view of the electrical connector of FIG. 1
Figure 8:
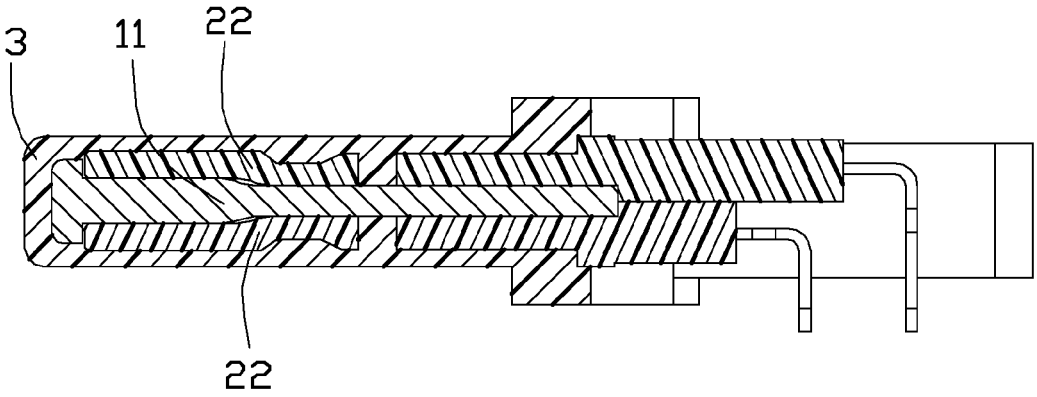
FIG. 8 is another cross-sectional view of the electrical connector of FIG. 1.

Combining to FIG. 6, each terminal module 2 defines a row of first injection holes 225, these injection holes 225 run through an upper and lower side of the insulative housing 22 which located between these retaining posts and the contacting portion 212 of the terminal 21. The concave portion 111 defines a row of second injection holes 1116 run through the tongue plate 11, at least one first injection hole 225 communicates to the second injection hole 1116 in a thickness direction of the electrical connector, said first injection hole 225 which is originally used for laterally holding the terminal 212 in position during forming the terminal module 2, and second injection hole 1116 are filled with the insulative material during forming the insulative shell 3. The tongue plate 11 further defines at least one third injection hole 1117 for injecting the insulative material of the insulative shell 3, said third injection hole 1117 is located at a juncture between the concave portion 111 and second wall portion 1112. When the outer side of the base plate 1 and the terminal modules 2 inserts molding with the insulative shell 3, said insulative shell 3 and tongue plate 11 are commonly forms a mating plate 31, said contacting portion 212 of the terminal 2 exposed to two opposite surfaces of the mating plate 31. The first retaining post 223 and the second retaining post 224 are located at a rear side of the first injection holes 225 and second injection holes 1116 in a mating direction.

Back referring to FIG. 4, the first wall portions 1111 has a great height than the second wall portions 1112, the contacting portion 212 has a same height as the first wall portion 1111 when the terminal module 2 received in the concave portion 111. Thus, said the tongue plate 11 can preferably inserts molding with said insulative shell 3, the terminal module 2 can be stably retained in the tongue plate 11.

Referring to FIGS. 1-6, a method of manufacturing said electrical connector usually comprising the following steps: providing a base plate 1 and a pair of concave portions 111 are formed on opposite sides of the base plate 1 respectively; providing a pair of terminal modules 2 and each terminal module 2 comprises a plurality of terminals 21 and an insulative housing 22 which inserted molding with the terminals 21; assembling the terminal module 2 to the concave portions 111 of the base plate 1; providing insulating material and insert molding the insulating material on an outer side of the terminal module 2, said insulating material flowing into the concave portion 111 and cladding around the terminal module 2 to form a insulative shell 3, said insulative shell 3 and base plate 1 are commonly form a mating plate or mating tongue 31, the terminal 21 defines a contacting portion 212 exposed to an exterior surface of the mating plate 31.

While a preferred embodiment in accordance with the present invention has been shown and described, equivalent modifications and changes known to persons skilled in the art according to the spirit of the present invention are considered within the scope of the present invention as described in the appended claims.

We claim:

1. An electrical connector comprising:

a base plate defining a tongue plate; and a pair of terminal modules, each terminal module comprising a plurality of terminals and an insulative housing inserted molding with the terminals; wherein a pair of concave portions are formed on opposite sides of the tongue plate, said two terminal modules are set in the two concave portions respectively, an insulative shell is injection molded over outer sides of the terminal modules and commonly forms a mating plate together with the tongue plate, the terminals define contacting portions exposed to two opposite surfaces of the mating plate;

wherein each terminal module defines at least one first injection hole for injecting insulating material of the insulative shell therein; wherein each concave portion of the tongue plate defines at least one second injection hole for injecting insulating material of the insulative shell therein, said at least one first injection hole communicates to the second injection hole in a thickness direction of the electrical connector; wherein each insulative housing defines a bottom surface abutting on the concave portion, said bottom surface defines at least one retaining post extending therefrom, the concave portion defines at least one retaining hole to receive said retaining post, said retaining hole runs through the tongue plate; wherein the insulative housing defines an upper surface opposite to the bottom surface, the contacting portions of the terminals protrudes out of the upper surface of the insulative housing.

2. The electrical connector as claimed in claim 1, wherein the base plate defines a pair of mounting portions located on opposite sides of a rear side of the tongue plate, each terminal module defines a front plate, a rear plate and a pair of protruding portions located on opposite sides of the terminal module in a lateral direction, said protruding portions abut on the rear side of the tongue plate, the front plate and rear plate are retained in the concave portion and two opposite mounting portions respectively.

3. The electrical connector as claimed in claim 1, wherein each concave portion defines a pair of first wall portions and a second wall portion, said two first wall portions are located on opposite sides of the concave portion in the lateral direction and the second wall portion which extends between said two first wall portions is located at a front side of the concave portion, said second wall portion and insulative shell combine together to form the mating plate.

4. The electrical connector as claimed in claim 1, wherein the base plate is inserted molding with metal material.

5. An electrical connector comprising:

a metallic base having a tongue plate defining opposite upper and lower surfaces thereon in a vertical direction;

an upper terminal module positioned upon the upper surface and including a upper insulative housing with a plurality of upper contacts embedded therein and side by side arranged with one another along a transverse direction perpendicular to said vertical direction;

a lower terminal module positioned upon the lower surface and including a lower insulative housing with a plurality of lower contacts embedded therein and side by side arranged with one another along said transverse direction;

said upper terminal module and said lower terminal module commonly sandwiching the tongue plate therebetween in the vertical direction to form an intermediate assembly; and an insulative cover overmolded upon said intermediate assembly; wherein the cover forms a complete exterior surface of a whole mating tongue of said electrical connector along a front-to-back direction perpendicular to both said vertical direction and said transverse direction; wherein said base further includes a pair of mounting portions located around a rear end of said tongue plate and spaced from each other in said transverse direction with therebetween a space accommodating a rear portion of said upper terminal module and a rear portion of said lower terminal module; wherein said rear portion of the upper terminal module and the rear portion of the lower terminal module are stacked with each other in the vertical direction; wherein the insulative cover forms a circumferential portion behind the mating tongue to circumferentially surround the base.

6. The electrical connector as claimed in claim 5, wherein each of said upper terminals and said lower terminals includes a raised and thickened contacting section, around a front end region, extending into a corresponding window in the mating tongue of said insulative cover and exposed to an exterior in the vertical direction in a coplanar manner with a corresponding exterior surface of said mating tongue.

7. The electrical connector as claimed in claim 5, wherein the tongue plate further defines in said vertical direction a pair of opposite concave portions in which the upper surface and the lower surface are formed, respectively.

8. The electrical connector as claimed in claim 5, wherein each of said mounting portions forms a through hole therein.

9. The electrical connector as claimed in claim 5, wherein said tongue plate further includes a pair of wall portions at opposite ends of the corresponding concave portion in said transverse direction, and an exterior surface of said pair of wall portions cooperate with the exterior surface of the insulative cover in a coplanar manner to commonly form a complete mating tongue in the transverse direction.

10. The electrical connector as claimed in claim 9, wherein each of said wall portions defines therein a retaining recess recessed in the vertical direction.

* * * * *